US006161715A

United States Patent [19]

Stolzman

[11] Patent Number: 6,161,715

[45] Date of Patent: Dec. 19, 2000

[54] PLASTIC PALLET BIN

[76] Inventor: Michael D. Stolzman, 1188 Old Colony Rd., Lake Forest, Ill. 60045

[21] Appl. No.: 09/425,441

[22] Filed: Oct. 22, 1999

Related U.S. Application Data

[63] Continuation-in-part of application No. 09/186,737, Nov. 5, 1998, Pat. No. 6,021,916.

[51] Int. Cl.[7] ..... B65D 1/42

[52] U.S. Cl. ..... 220/1.5; 220/653

[58] Field of Search ..... 220/1.5, 4.28, 220/4.29, 4.33, 6, 7, 645, 673, 675, 639, 651, 653; 206/386, 600, 389, 397

[56] References Cited

U.S. PATENT DOCUMENTS

| | | | |
|---|---|---|---|
| 4,231,482 | 11/1980 | Bogan | 220/4.13 |
| 4,643,314 | 2/1987 | Kidd | 206/600 |
| 4,883,178 | 11/1989 | Thiele et al. | 206/391 |
| 5,564,599 | 10/1996 | Barber et al. | 222/105 |
| 6,021,916 | 2/2000 | Stolzman | 220/675 |

*Primary Examiner*—Stephen Castellano
*Attorney, Agent, or Firm*—Wood, Phillips, VanSanten, Clark & Mortimer

[57] ABSTRACT

A pallet bin comprises a generally rectangular base having a generally planar support surface. A pair of opposite side panels and a pair of opposite end panels between the side panels each stand vertically at one side of the rectangular base to define a parallelepiped interior space. Each of the side panels and end panels comprises a planar outer wall and a planar inner wall and an internal rib structure connecting the outer wall spaced from the inner wall to define hollow portions therebetween. A tubular column is supported on the base within the interior space.

20 Claims, 11 Drawing Sheets

PLASTIC PALLET BIN

CROSS REFERENCE

This application is a continuation in part of application Ser. No. 09/186,737 filed Nov. 5, 1998 now U.S. Pat. No. 6,021,916.

FIELD OF THE INVENTION

The present invention is directed toward the shipment of bulk goods and, more particularly, to a plastic pallet bin for storing and shipping goods.

BACKGROUND OF THE INVENTION

A pallet bin is used to store and ship goods of liquid, solid, and granular materials. A typical pallet bin is constructed of plywood panels with a built-in pallet base. The pallet bin to is generally of all wood construction including a wood bottom panel screwed or nailed to a conventional wooden pallet. Plywood side and end panels are held together using corner angle and placed atop the bottom panel and are secured using retaining brackets. A plywood top can be placed atop the side and end panels. A plastic liner is placed inside the bin to prevent the product from coming into direct contact with the wood panels. Such a bin typically has a three hundred gallon capacity.

In use, a large plastic aseptic bag is placed in the bin and sealed. The bag may include a food product such as a puree from fruits or vegetables. The bin acts as a skeleton to transport the processed food. When the bag is empty it is thrown away. Typically, the pallet bins are collapsible as by breaking down the top cover and the side and end walls and stacking them on the bottom panel. The bin can then be shipped back to the supplier. Such use typically also requires use of banding for supporting the wood panels. Without the banding, the wood panels might not hold the product. Also, wood splinters and improperly placed nails can destroy the bags. Moreover, after repeated nailing, the wood panels become weaker and therefore must be disposed of. This contributes to the escalating problem of waste disposal.

More recently, pallet bins have been constructed principally of plastic. These bins typically utilize interlocking structure for holding the various components together. However, due to the need for strength, while limiting weight, plastic pallet bins typically incorporate structures having numerous voids. However, dirt, insects and rodents could gather in such voids. This could render the products undesirable for use in the food industry.

The present invention is directed to overcoming one or more of the problems discussed above in a novel and simple manner.

SUMMARY OF THE INVENTION

In accordance with the invention, a pallet bin includes an interior column.

Broadly, there is disclosed herein a pallet bin including a generally rectangular base having a support surface with an upper central bore. A pair of opposite side panels and a pair of opposite end panels are provided between the side panels. Each panel stands vertically at one side of the rectangular base to define a parallelepiped interior space. A column in the interior space has a bottom end received in the central bore. A cover is receivable along a top edge of each of the panels to close the interior space.

It is a feature of the invention that the central bore defines a through opening. The cover includes a through opening receiving a top end of the column to permit circulation through an interior of the column.

It is another feature of the invention that the column is friction fit in the bore.

It is a further feature of the invention that the base includes an upwardly extending flange surrounding the bore.

It is still a further feature of the invention that the cover includes a bore receiving a top end of the column. The column is friction fit in each bore.

It is still a further feature of the invention that the cover includes a downwardly extending flange surrounding the cover bore.

It is yet another feature of the invention that the column comprises a tubular column.

It is still an additional feature of the invention that the column comprises a cardboard column.

There is disclosed in accordance with another aspect of the invention a plastic pallet bin including a generally rectangular base having a generally planar support surface with an upper central bore. A pair of opposite side panels and a pair of opposite end panels are provided between the side panels. Each panel stands vertically at one side of the rectangular base to define a parallelepiped interior space. Each of the side panels and end panels comprises a planar outer wall and a planar inner wall and an internal rib structure connecting the outer wall space from the inner wall to define hollow portions therebetween. A column in the interior space has a bottom end received in the central bore. A cover is receivable along a top edge of each of the panels to close the interior space. The base, cover and panels are of molded plastic construction.

Further features and advantages of the invention will be readily apparent from the specification and from the drawings.

DETAILED DESCRIPTION OF THE INVENTION

Figure 1:
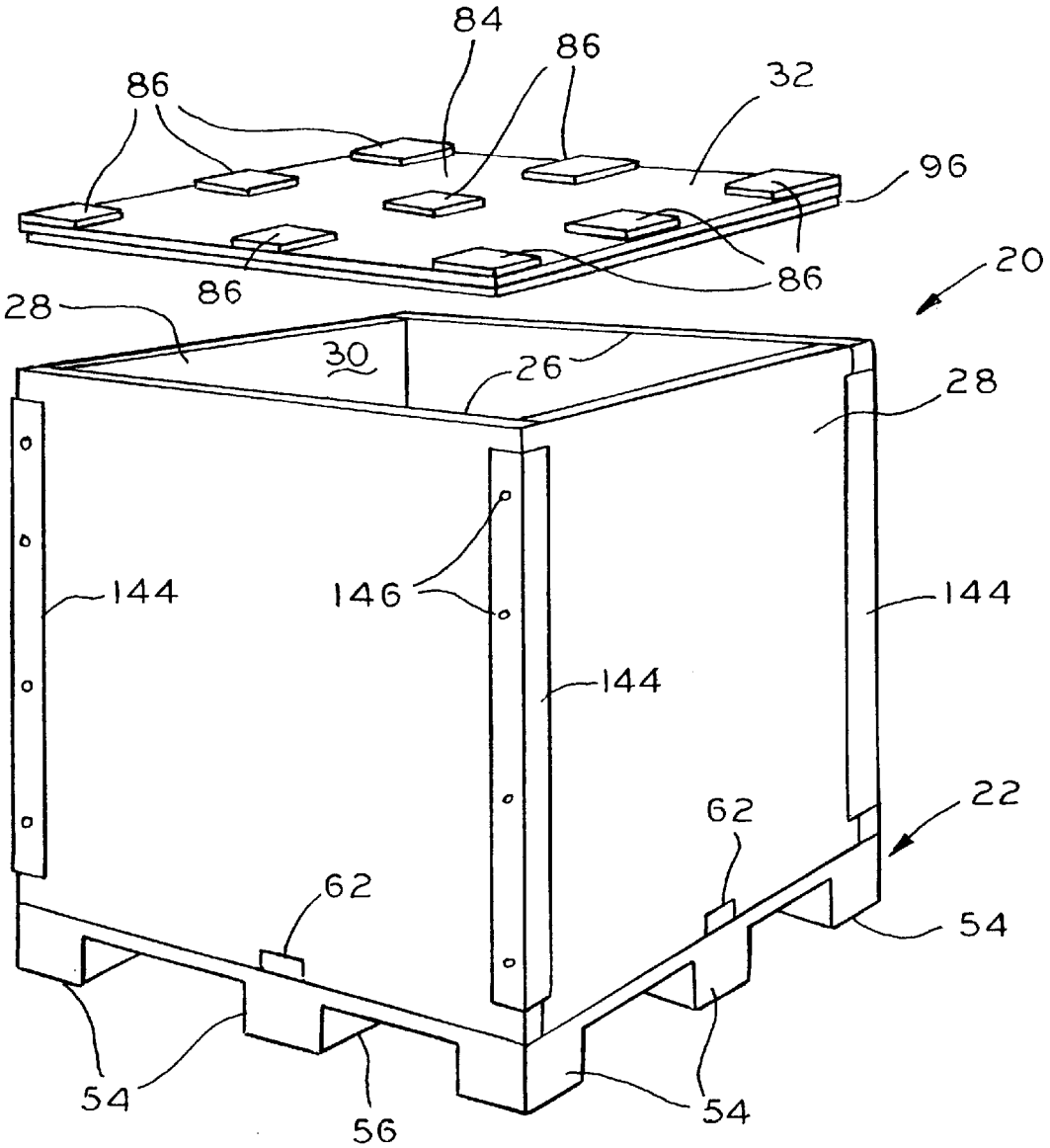
FIG. 1 is a perspective view of a pallet bin according to one embodiment of the invention.
Figure 2:
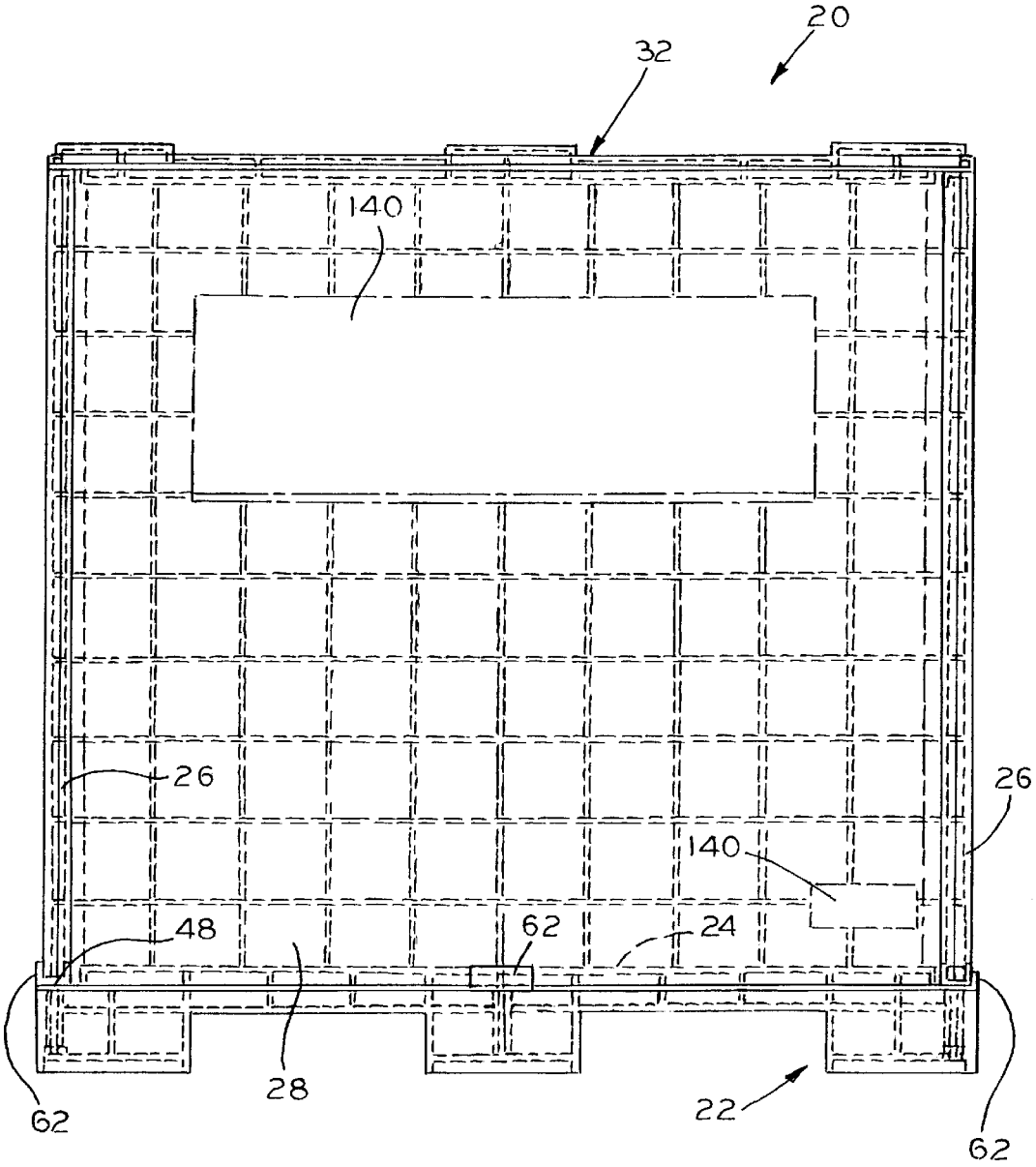
FIG. 2 is a front elevation view of the pallet bin of FIG. 1 with corner braces removed.
Figure 3:
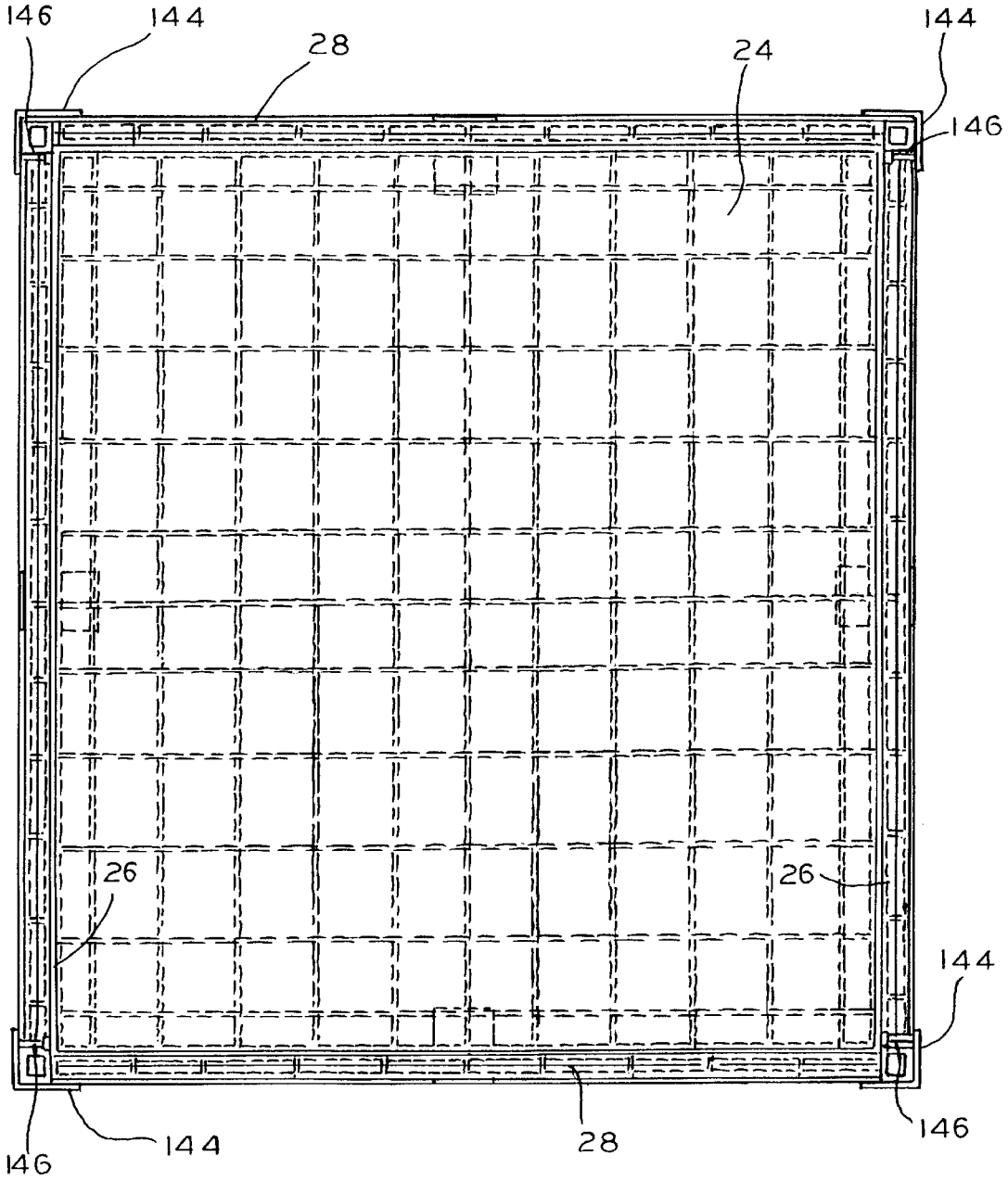
FIG. 3 is a plan view of the bin of FIG. 1 with the cover removed.

Referring to FIGS. 1–3, a pallet bin 20 according to the invention is illustrated. The pallet bin 20 is particularly adapted for bulk shipment of goods such as liquid, solid and granular materials, and is approximately 44" W by 48" L by 44" H to provide approximately a three hundred gallon capacity. As is apparent, the pallet bin 20 could be of smaller size, as necessary or desired, according to the particular shipping and storage requirement.

FIGS. 2–10 of the drawing illustrate various views of the pallet bin 20 or its component parts. Each of these figures illustrates the outline of the particular part(s) in solid line and includes phantom or dashed lines to illustrate internal structure of the various component parts, as the internal structure is a significant aspect of the invention as will be apparent.

The bin 20 includes a generally rectangular base 22 having a generally planar support surface 24. The bin includes a pair of opposite side panels 26 and a pair of opposite end panels 28. The end panels 28 are disposed between the side panels 26. Each panel 26 and 28 stands vertically on one side of the rectangular base 22 to define a parallelepiped interior space 30. In use, the interior space 30 is filled with a plastic liner or bag (not shown) which contains the material to be stored and/or shipped. A top cover 32 is placed atop the panels 26 and 28 to close the interior space 30. In accordance with the invention, the base 22, the panels 26 and 28, and the top cover 32 are each of one piece plastic construction, such as high density polyethylene. Particularly, each is initially molded into two separate parts each having various walls and ribs, as described, all approximately one quarter inch thick throughout. The two parts are then hot plate welded together to form the individual structural elements, as described more particularly below.

Figure 4:
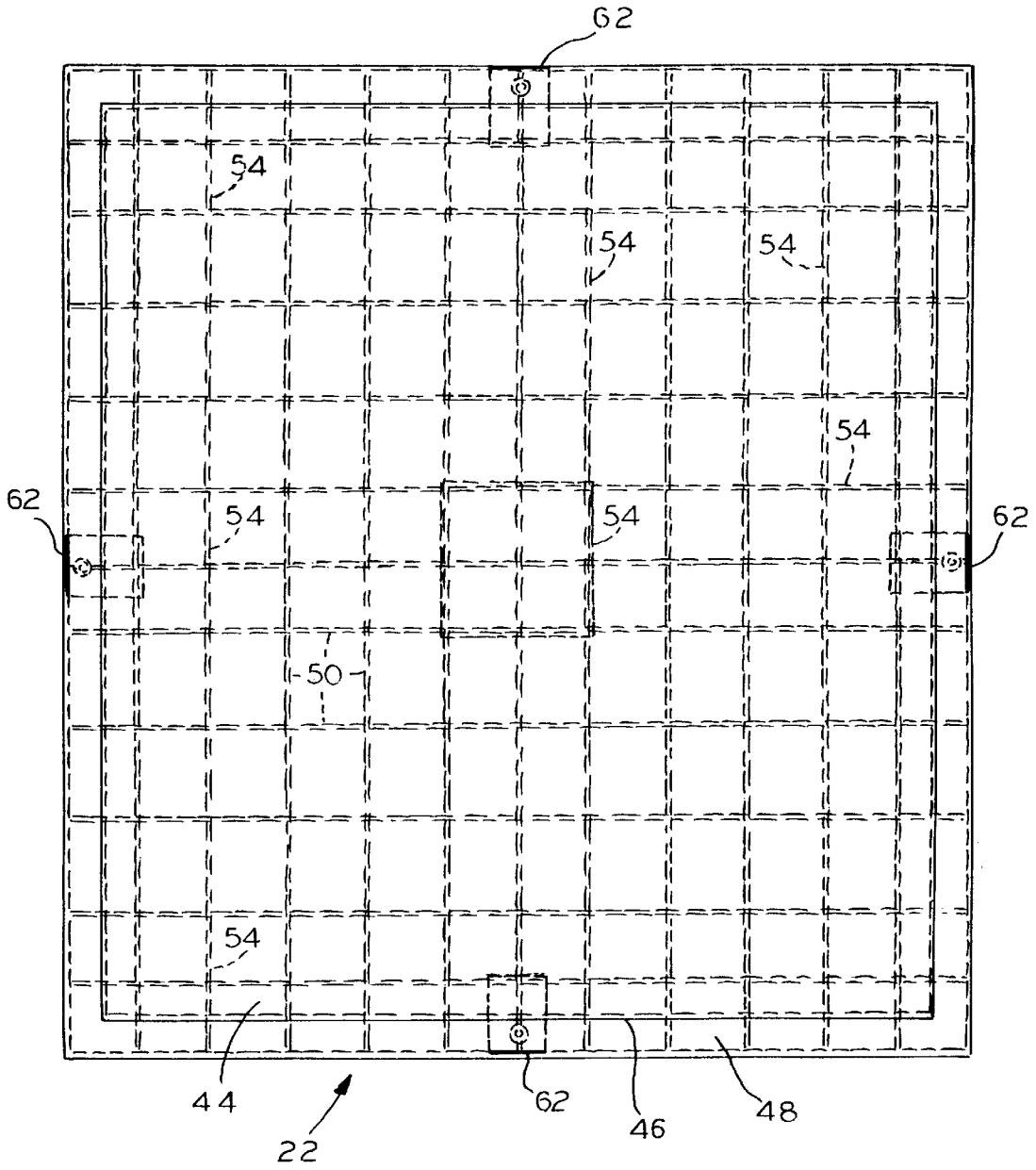
FIG. 4 is a plan view of a base of the pallet bin of FIG. 1.
Figure 5:
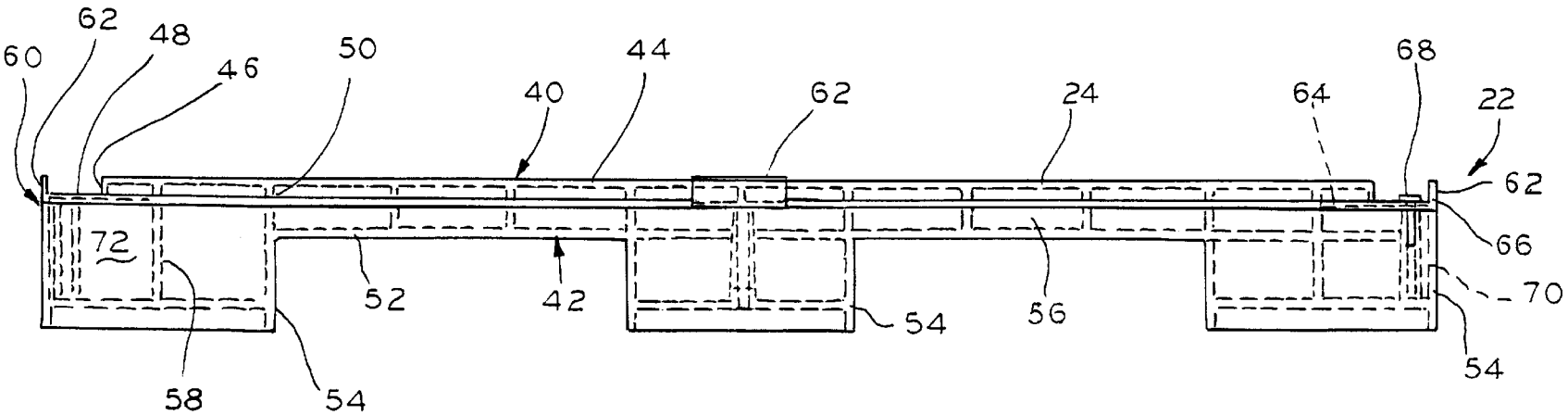
FIG. 5 is a front elevation view of the base of FIG. 4.

Referring to FIGS. 4 and 5, the base 22 is illustrated. The base comprises a formed upper portion 40 and a formed bottom portion 42. The upper portion 40 is of molded plastic construction and includes a planar upper wall 44 which defines the planar support surface 24. The planar upper wall 44 is generally rectangular and includes a downwardly turned perimeter edge 46 connecting an outwardly turned planar peripheral flange 48. The flange 48 defines a peripheral channel opening upwardly from adjacent the bottom wall 44. The channel 48 receives the panels 26 and 28, as shown in FIG. 2. Extending downwardly from the upper wall 44 inside the peripheral side edge 46 is an integral rib structure 50 in the configuration of a mesh rib, as illustrated in phantom in FIG. 4.

The bottom portion 42 is formed to include a bottom wall 52 having integral downwardly extending feet 54. A foot 54 is provided at each corner and centrally between each pair of corners for a total of nine, as illustrated in FIG. 5. Particularly, one is provided at each corner, one centrally located at each side edge between corners, and one located in the center of the base 22. The feet 54 are adapted to rest on a support surface such as a floor, a warehouse shelf, or another pallet bin, as described more particularly below. The bottom wall 52 is surrounded by an upwardly turned peripheral wall 56 which also surrounds each of the feet 54. Extending upwardly from the bottom wall 52 and internally of the feet 54, and surrounded by the wall 56, is an internal rib structure 58 also in the configuration of a mesh rib. The rib structure 58 is adapted to be aligned with the upper portion rib structure 50 when the upper portion 40 is placed atop the bottom portion 42. The upper portion 40 and bottom portion 42 are hot plate welded together along a weld line 60. Particularly, a hot plate is placed between the two portions to melt plastic on both sides. The two melted surfaces are then placed together under pressure. Upon cooling, the base 22 becomes an integral one piece unit. Indeed, the integrity of the plastic is stronger at the weld portion than elsewhere.

Four L-brackets 62 are secured to the base 22. Each L-bracket 62 has a horizontal portion 64 and vertical portion 66. The horizontal portion 64 may be secured to the base 22 as by being integrally molded or welded therein, or may use a fastener such as a fastener 68 threaded into an opening 70 provided within each foot 54 for receiving the fastener 68. Each L-bracket 62 is positioned centrally of each side portion of the flange 48 with the vertical portion 66 supporting the panels 26 and 28 in the channel, as shown in FIGS. 1 and 2.

With the base so constructed, the upper mesh rib 50 and bottom mesh rib 58 are welded together to provide an I-beam structure to strengthen the base 22. This results in a plurality of hollow internal wells 72 in a checkerboard configuration which reduces weight of the base 22 while maintaining stiffness and strength.

Figure 7:
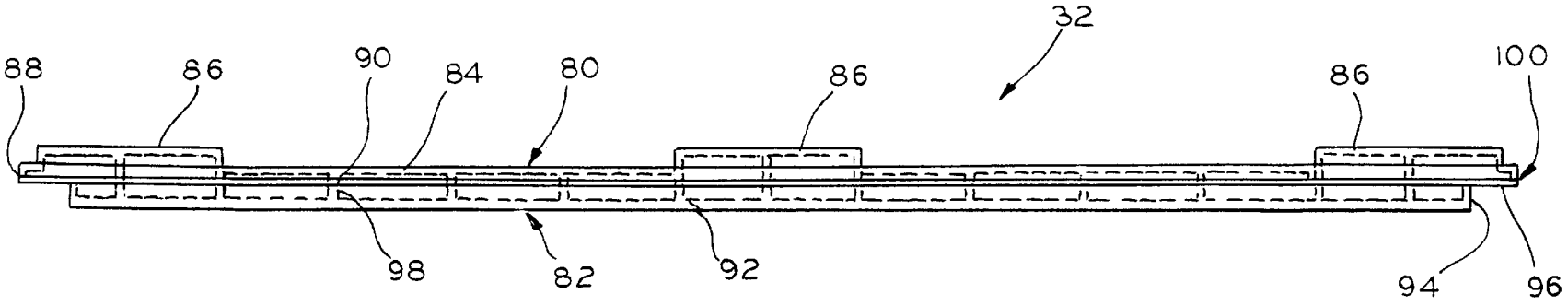
FIG. 7 is a side elevation view of the cover of FIG. 6.
Figure 6:
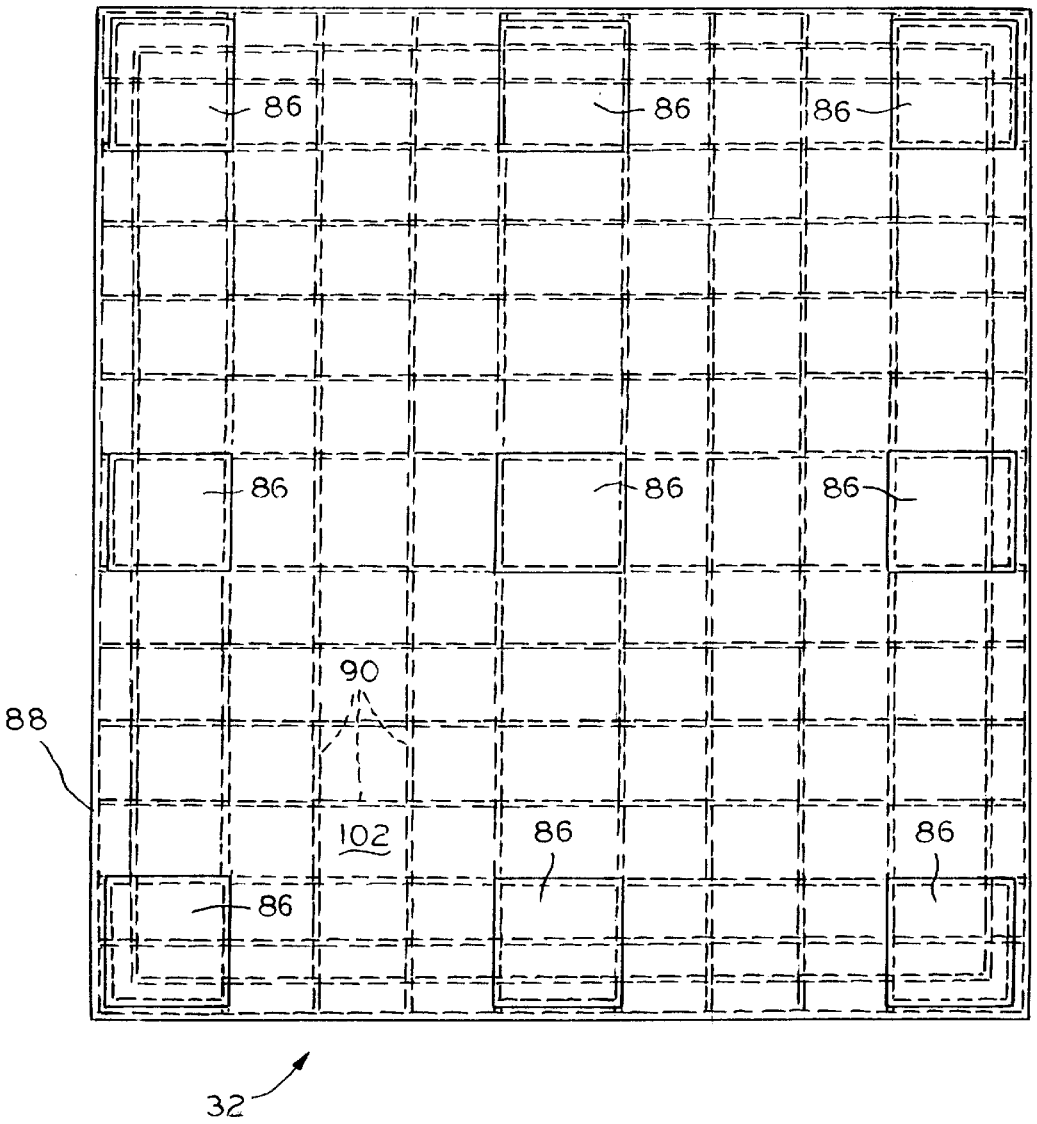
FIG. 6 is a plan view of a cover of the pallet bin of FIG. 1.

Referring to FIGS. 6 and 7, the top cover 32 is illustrated. The top cover 32 is formed using similar techniques to the base 22. Particularly, the top cover 32 includes an upper portion 80 and a lower portion 82. The upper portion 80 comprises a generally planar wall 84 having nine upwardly extending rectangular supports 86 positioned similarly to the feet 54. There is an upper support 86 at each comer, along side edges between each comer, and in a center of the cover 32. The supports 86 are positioned so that when the top cover 32 is placed atop the pallet bin 20, another pallet bin can be stacked on top with the feet 54 of the upper pallet bin resting on the supports 86. A peripheral side edge wall 88 extends downwardly from the planar wall 80. An internal rib structure 90 in the configuration of a mesh rib extends downwardly from the upper wall 84 and the supports 86 inside the peripheral edge wall 88.

The lower portion 82 includes a planar inner wall 92 connected to a peripheral upwardly extending side edge 94 that is in turn connected to an outwardly extending peripheral flange 96. An internal rib structure 98 in the configuration of a mesh rib extends upwardly from the inner wall 92 inside the peripheral side edge 94. As with the base, the rib structures 90 and 98 are adapted to be aligned with one another with the upper portion 80 placed atop the lower portion 82 as shown. The two parts are then hot plate welded together along a weld line 100 to provide an integral one-piece top cover 32. The integrally welded rib structures 90 and 98 again provide an I-beam-like construction with hollow internal wells 102 in a checkerboard configuration therebetween reducing weight of the top cover 32 while maintaining stiffness and strength. The rectangular size of the inner wall 88 corresponds to that of the base upper wall 44 so that the side edge 94 is received within the interior space 30 with the flange 96 resting atop the panels 26 and 28 to close the space.

Figure 8:
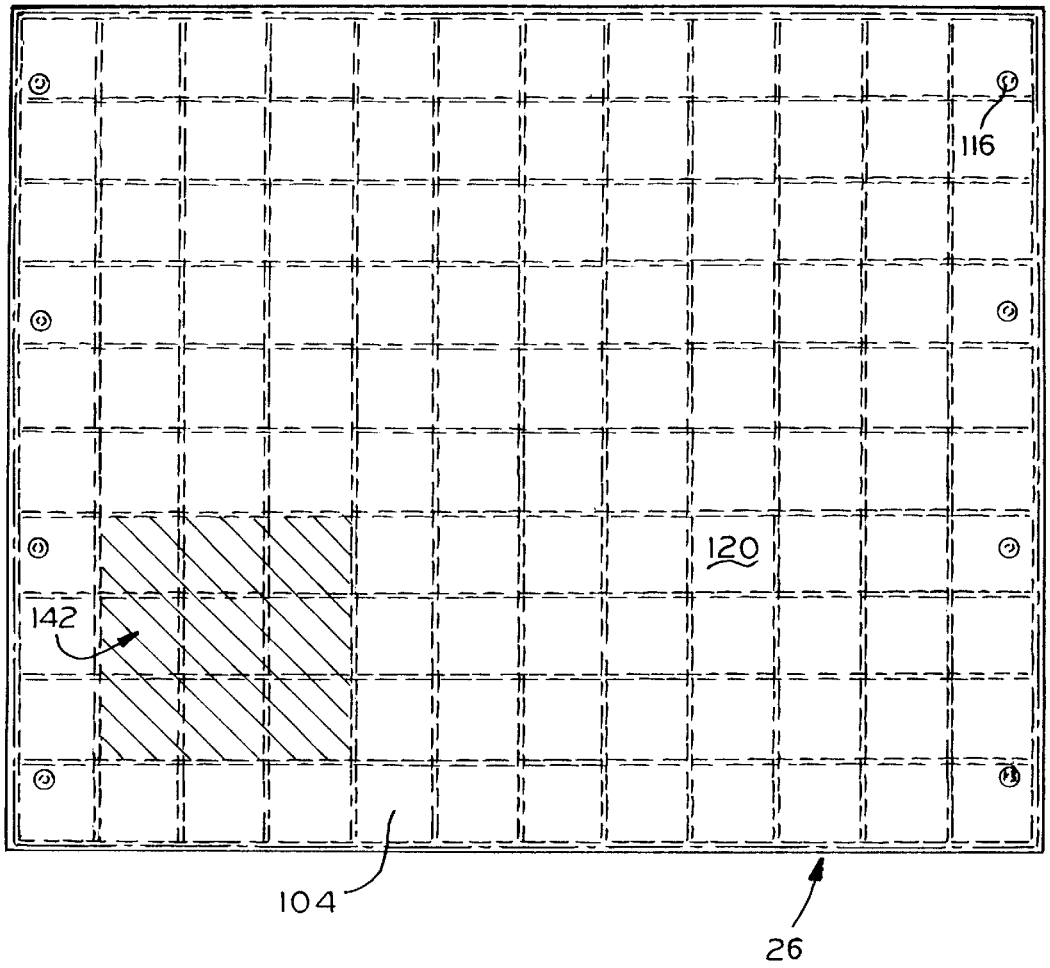
FIG. 8 is an elevation view of a side panel of the pallet bin of FIG. 1.
Figure 9:
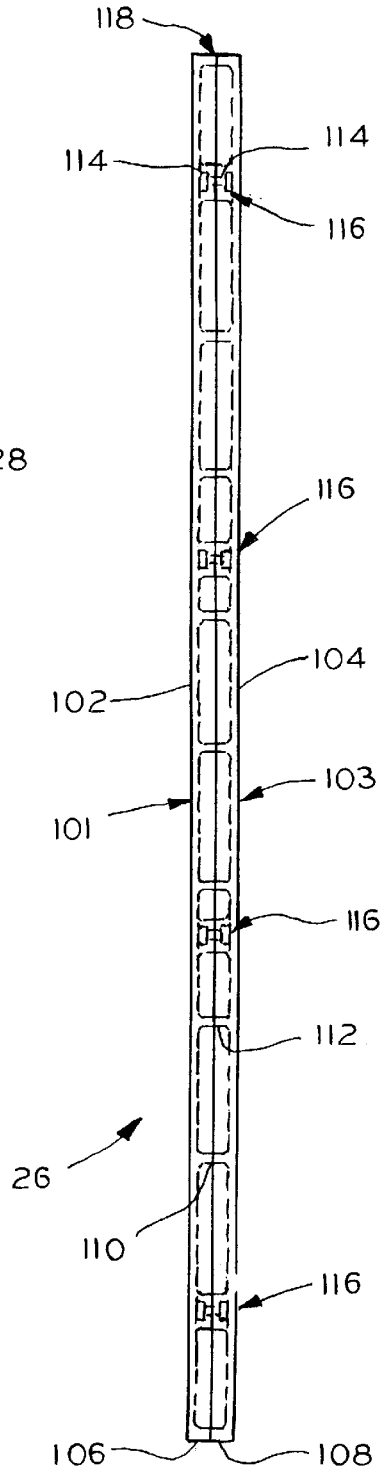
FIG. 9 is a side elevation view of the side panel of FIG. 8.

Referring to FIGS. 8 and 9, one of the side panels 26 is illustrated. While only one is shown, the opposite side panel 26 is of identical construction.

The side panel 26 includes a an inner portion 101 having planar inner wall 102 and an outer portion 103 having a planar outer wall 104. The planar inner wall 102 is connected to an outwardly extending peripheral edge wall 106. Similarly, the outer wall 104 is connected to an inwardly extending peripheral edge wall 108. Extending outwardly from the inner wall 102 is an internal rib structure 110 in the configuration of a mesh rib inside the peripheral edge wall 106. Similarly, extending inwardly from the outer wall 104 is an internal mesh rib 112. Along each vertical edge four vertically spaced bosses 114 extend from each wall 102 or 104 toward the other to form through openings 116. As with the base 22 and cover 32, the inner portion 101 and outer portion 103 are welded together along a weld line 118 using hot mold welding. This results in an I-beam structure with a plurality of hollow internal wells 120 in a checkerboard configuration to reduce weight of the side panel 26 while maintaining stiffness and strength.

Figure 10:
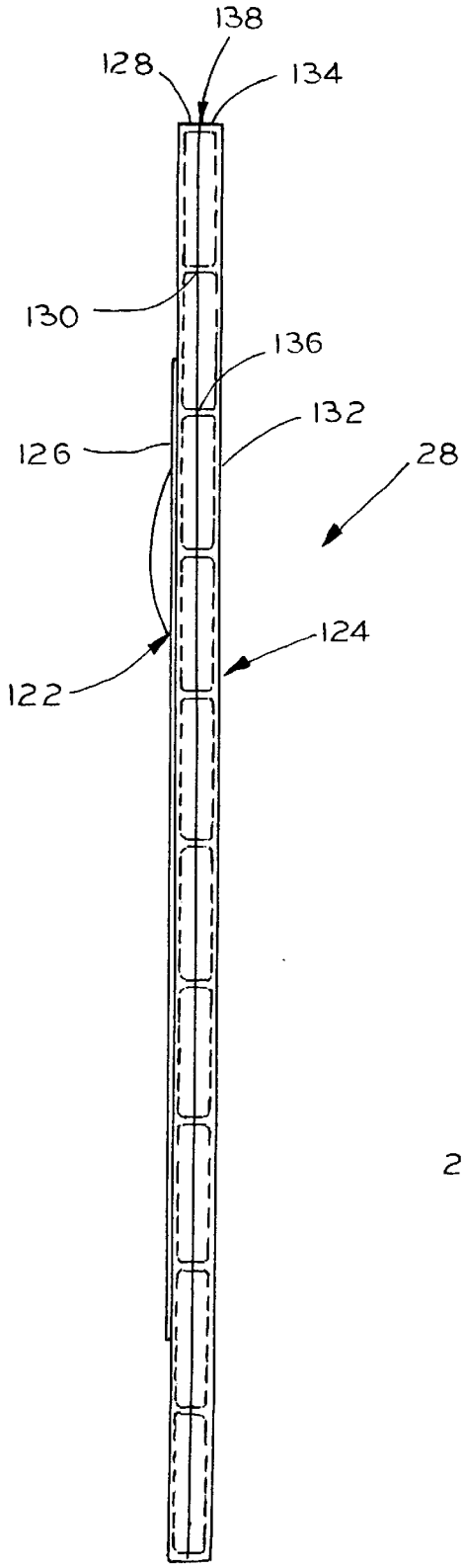
FIG. 10 is a side elevation view of an end panel of the pallet bin of FIG. 1.

The end panels 28 are generally similar to the side panels 26, albeit of smaller length. Likewise, the end panels 28 do not include the through openings 116. As illustrated in FIG. 10, the end panels 28 include an inner portion 122 and an outer portion 124. The inner portion 122 includes a planar inner wall 126 connected to a peripheral edge wall 128 and having an internal mesh rib structure 130. Similarly, the outer portion 124 includes a planar outer wall 132 connected to a peripheral edge wall 134 and having an internal mesh rib structure 136. The inner portion 122 and outer portion 124 are hot plate welded together along a weld line 138.

In accordance with the invention, the base upper surface 24 and the panel inner walls 102 and 126 comprise generally smooth planar surfaces. As illustrated in FIG. 2, the outer surface of the end panel 28 may be smooth or have a textured surface. If a textured surface is included, then a generally rectangular polished areas 140 may be provided for adding a product label. Similarly, the side panel 26 may include a polished area 142, see FIG. 8, for labeling or the like.

To support the end panels 28 relative to the side panels 26, four heavy gauge steel L-brackets 144 are used, one at each corner. Each L-bracket 144 extends less than the vertical height of the panels 26 and 28. Each bracket 144 is secured using threaded fasteners 146 extending through the openings 116 in the side panels 26.

When not used, the panels 26 and 28 and the top cover 32 can be stacked atop the base 22 for storage or shipment back to a supplier. When ready to be used, the side panels 26 are stood vertically at one side of the rectangular base 22 in the channel 48. The end panels 28 are then similarly placed in the channel 48 between the side panels 26. Outward movement of the end panels 28 is restricted by the corner brackets 144. When the top cover 32 is installed, the end panels 28 are prevented from moving inwardly. Moreover, once the interior space 30 is filled, then the contents will also force the end panels 28 outwardly against the corner brackets 144 to maintain the pallet bin 20 in assembled construction. Once assembled, then plural pallet bins 20 can be stacked atop one another with the feet 54 resting on the nesting structures 86, as described.

A pallet bin of the type described may be used for shipping frozen goods. One example of such an application is the shipment of frozen orange juice sold in bulk. With such an application a bag is inserted in the pallet bin and filled with orange juice. The pallet bin is then frozen. During the freezing process the juice freezes from the outsides to the inside. There is a concern that with a square bin the juice in the center may take too long to freeze, rendering the entire contents unuseable.

Figure 11:
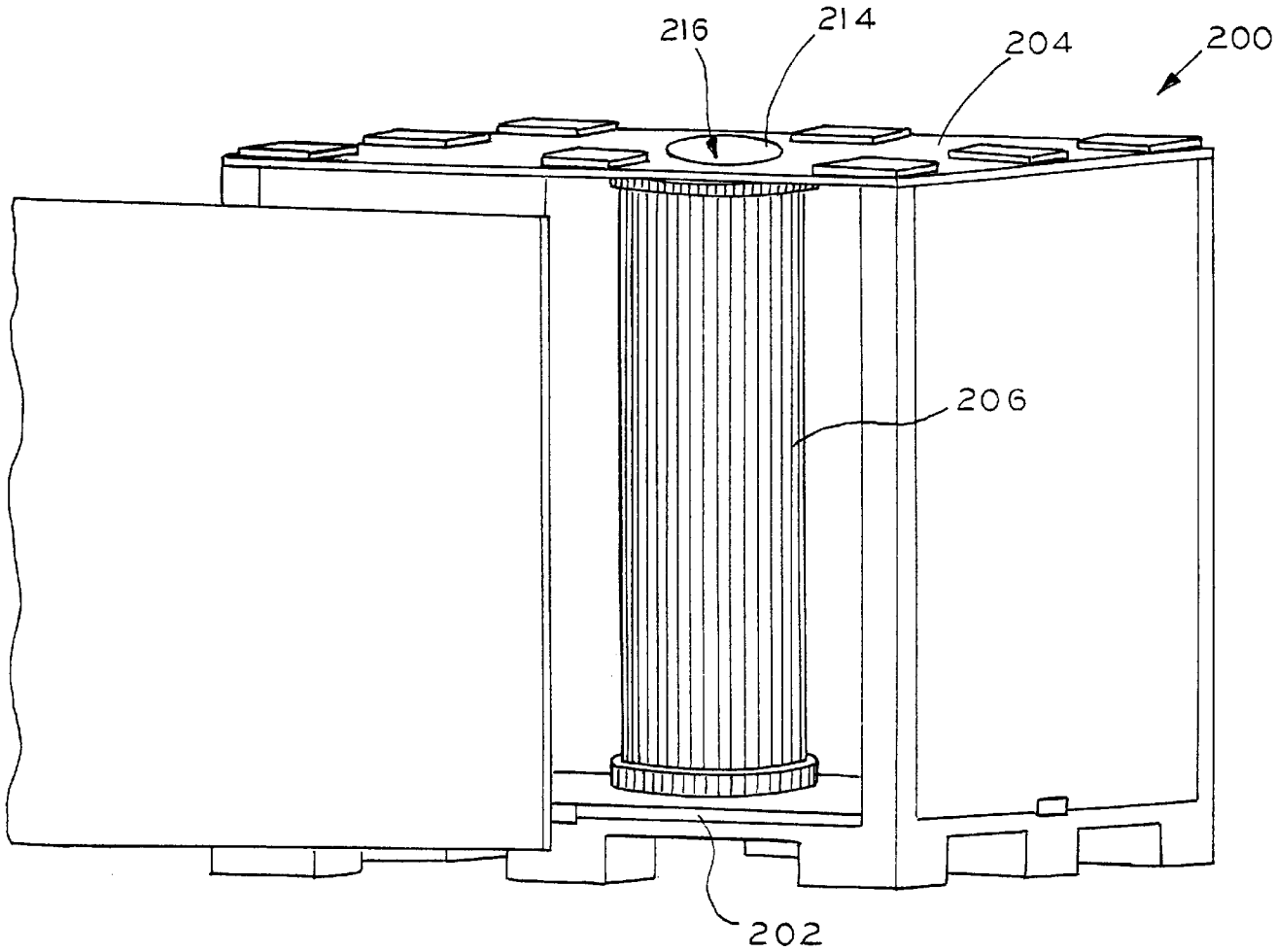
FIG. 11 is a perspective view of a plastic pallet bin according to an alternative embodiment of the invention including a tubular column.
Figure 12:
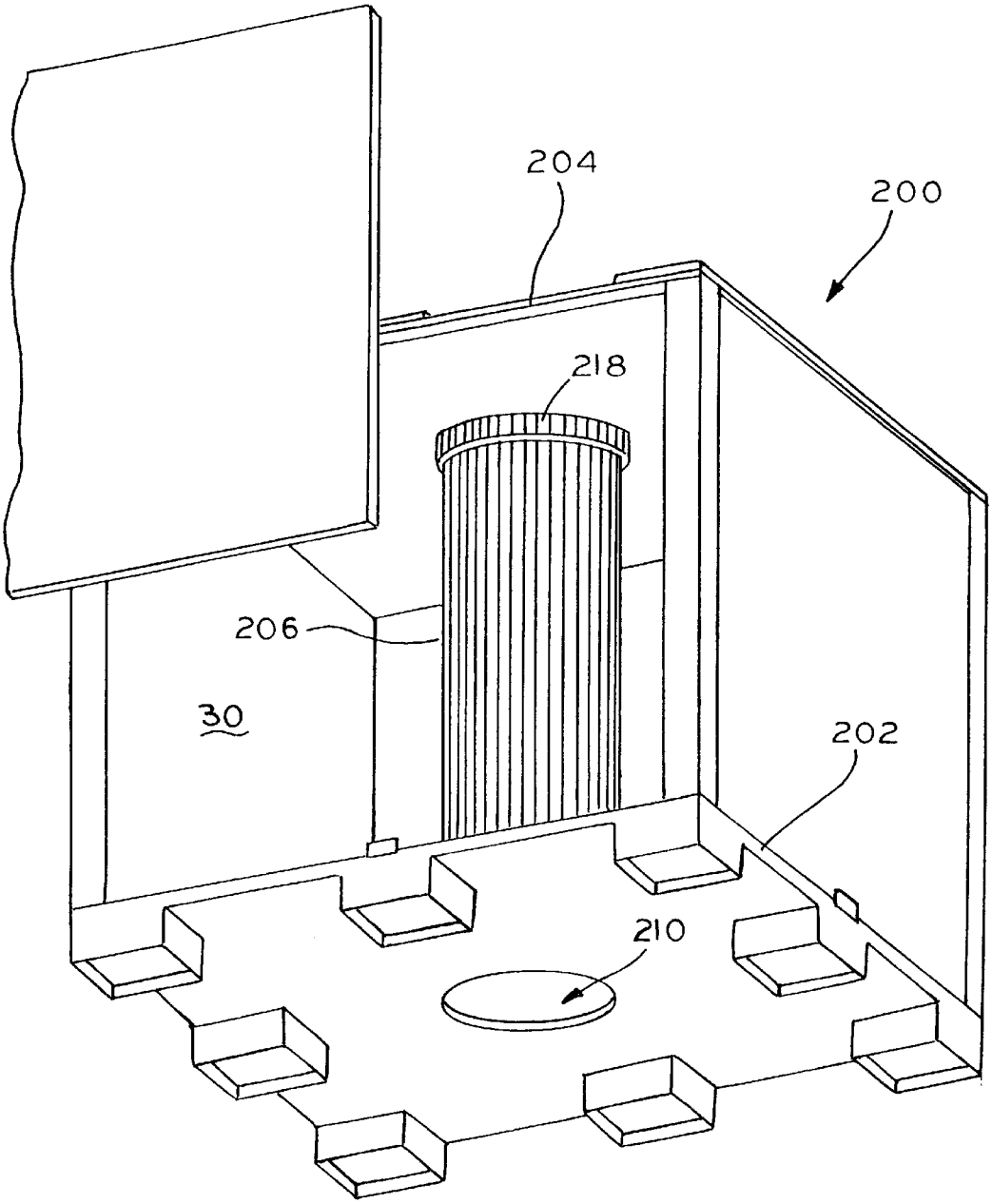
FIG. 12 is a bottom perspective view of the pallet bin of FIG. 11.
Figure 13:
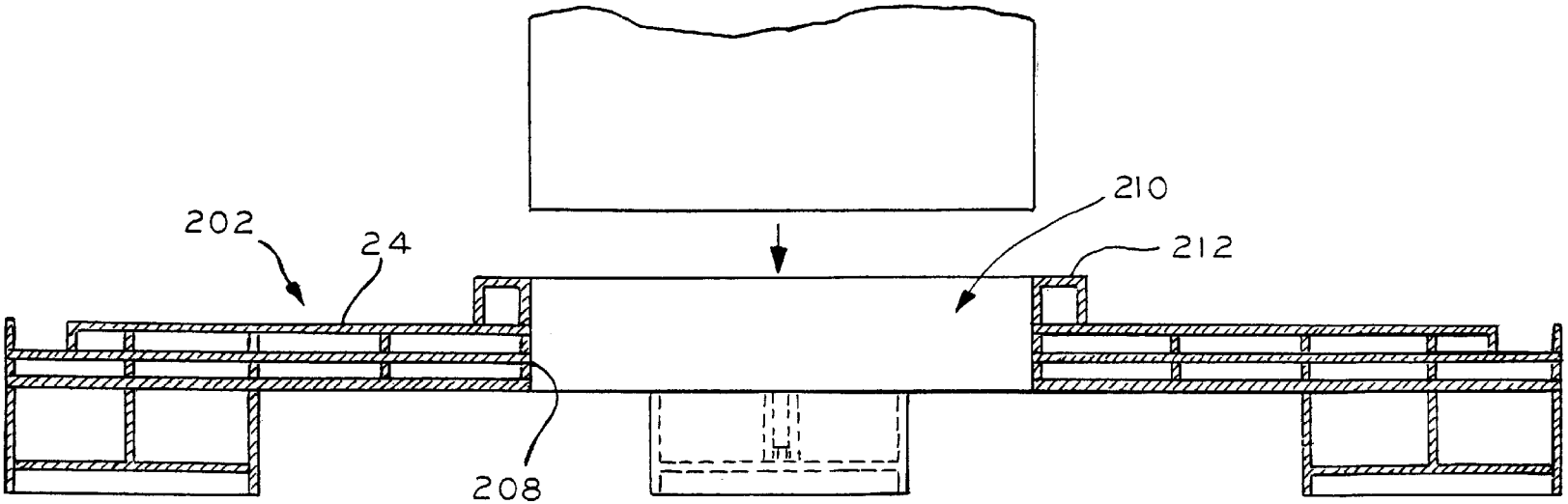
FIG. 13 is a sectional view similar to that of FIG. 5, for the base used with the bin of FIG. 11 and illustrating installation of the column in the base.

In accordance with the invention, an alternative bin 200, see FIGS. 11 and 12, is illustrated. The pallet bin 200 is identical to the pallet bin 20 of FIG. 1 in all respects, except for a base 202 and a cover 204 being modified to receive a centrally located tubular column 206. Particularly, and with reference also to FIG. 13, the base 202 is identical in all respects to the base 22 of FIG. 4 except for the addition of a central bore 208 to define a through opening 210. For simplicity, like-referenced numerals are used for elements similar to those discussed above. A circular flange 212 extends upwardly from the support surface 24 surrounding the opening 210. The flange 212 may be integrally formed with an upper portion of the base 202. A central circular wall is provided in both an upper portion and a lower portion which are then hot plate welded in a manner similar to that discussed above to produce the base 202.

The cover 204 is identical to the cover 32 of FIG. 6 except for the addition of a central bore 214 to define a through opening 216. A circular flange 218 is integrally formed with the cover 204 and surrounds the opening 216. The cover 204 is likewise formed in the manner described relative to the cover 32 but modified to include the bore 214, as with the base 202.

The column 206 is telescopically received within the base through opening 210 and the cover through opening 216. Particularly, the column 206 has an outer diameter similar to or slightly larger than an inner diameter of the through openings 210 and 216 to be held therein by friction. The flanges 212 and 218 extend the height of the respective openings 210 and 216 for stability. Alternatively, shoulders could be provided in the opening 210 and 216 to sandwich the column 206.

The column 206 might be a throwaway column such as cardboard or the like. Although not shown, a donut-shaped bag may be inserted in the interior space 30 and surrounding the column 206. Because the column 206 is hollow, ambient air is permitted to circulate through the column 206 via the bottom opening 210 and/or the top opening 216. Thus, the contents of the space 30 including in a bag, will then freeze both from the inside out and outside in to provide greater uniformity in freezing and thus minimize waste. Alternatively, the bores 210 and 216 could comprise counterbores, if air flow through the column 206 is not required. The column 206 also acts as a support pillar which prevents any bag from collapsing.

Thus, the invention relates to the use of a column in the interior space of a pallet bin to facilitate the storage and shipment of frozen goods or the like.

The invention also relates to a plastic pallet bin having planar inner and outer sidewalls having integral rib structures to reduce weight of the pallet bin while maintaining stiffness of the individual panels.

I claim:

1. A pallet bin comprising:

a generally rectangular base having a support surface with an upper central bore;

a pair of opposite side panels and a pair of opposite end panels between the side panels, each panel standing vertically at one side of the rectangular base to define a parallelepiped interior space;

a column in the interior space having a bottom end received in the central bore; and a cover receivable along a top edge of each of the panels to close the interior space.

2. The pallet bin of claim 1 wherein the central bore defines a through opening.

3. The pallet bin of claim 2 wherein the cover includes a through opening receiving a top end of the column to permit circulation through an interior of the column.

4. The pallet bin of claim 1 wherein the column is friction fit in the bore.

5. The pallet bin of claim 1 wherein the base includes an upwardly extending flange surrounding the bore.

6. The pallet bin of claim 1 wherein the cover includes a bore receiving a top end of the column.

7. The pallet bin of claim 6 wherein the column is friction fit in each bore.

8. The pallet bin of claim 6 wherein the cover includes a downwardly extending flange surrounding the cover bore.

9. The pallet bin of claim 1 wherein the column comprises a tubular column.

10. The pallet bin of claim 1 further wherein the column comprises a cardboard column.

11. A plastic pallet bin comprising:

a generally rectangular base having a generally planar support surface with an upper central bore;

a pair of opposite side panels and a pair of opposite end panels between the side panels, each panel standing vertically at one side of the rectangular base to define a parallelepiped interior space, each of the side panels and end panels comprising a planar outer wall and a planar inner wall and an internal rib structure connecting the outer wall spaced from the inner wall to define hollow portions therebetween;

a column in the interior space having a bottom end received in the central bore; and a cover receivable along a top edge of each of the panels to close the interior space, the base, cover and the panels being of molded plastic construction.

12. The plastic pallet bin of claim 11 wherein the central bore defines a through opening.

13. The plastic pallet bin of claim 12 wherein the cover includes a through opening receiving a top end of the column to permit circulation through an interior of the column.

14. The plastic pallet bin of claim 11 wherein the column is friction fit in the bore.

15. The plastic pallet bin of claim 11 wherein the base includes an upwardly extending flange surrounding the bore.

16. The plastic pallet bin of claim 11 wherein the cover includes a bore receiving a top end of the column.

17. The plastic pallet bin of claim 16 wherein the column is friction fit in each bore.

18. The plastic pallet bin of claim 16 wherein the cover includes a downwardly extending flange surrounding the cover bore.

19. The plastic pallet bin of claim 11 wherein the column comprises a tubular column.

20. The plastic pallet bin of claim 11 further wherein the column comprises a cardboard column.

* * * * *